US005716917A

United States Patent [19]

Williams et al.

[11] Patent Number: 5,716,917

[45] Date of Patent: Feb. 10, 1998

[54] MACHINING FLUID COMPOSITION AND METHOD OF MACHINING

[75] Inventors: Mark A. Williams, Cincinnati; Henry Turchin; Mark K. Krueger, both of Loveland, all of Ohio

[73] Assignee: Cincinnati Milacron Inc., Cincinnati, Ohio

[21] Appl. No.: 719,240

[22] Filed: Sep. 24, 1996

[51] Int. Cl.[6] ..... C10M 149/00

[52] U.S. Cl. ..... 508/547; 72/42

[58] Field of Search ..... 508/547; 72/42; C10M 173/00

[56] References Cited

U.S. PATENT DOCUMENTS

| | | | |
|---|---|---|---|
| 3,771,989 | 11/1973 | Perry et al. | 71/67 |
| 4,018,592 | 4/1977 | Buckman et al. | 71/67 |
| 4,053,426 | 10/1977 | Davis | 508/469 |
| 4,054,542 | 10/1977 | Buckman et al. | 260/2 |
| 4,089,977 | 5/1978 | Green et al. | 424/329 |
| 4,149,983 | 4/1979 | Grier et al. | 508/257 |
| 4,506,081 | 3/1985 | Fenyes et al. | 548/523 |
| 4,581,058 | 4/1986 | Fenyes et al. | 71/67 |
| 4,606,890 | 8/1986 | Fisk | 422/15 |
| 4,730,079 | 3/1988 | Hofinger et al. | 560/196 |
| 4,927,550 | 5/1990 | Cutcher et al. | 508/170 |
| 4,960,590 | 10/1990 | Hollis et al. | 424/78 |
| 5,198,440 | 3/1993 | Oppong et al. | 514/241 |
| 5,229,030 | 7/1993 | Clubley et al. | 252/389.23 |
| 5,294,371 | 3/1994 | Clubley et al. | 252/389.23 |
| 5,371,083 | 12/1994 | Hollis | 514/241 |

FOREIGN PATENT DOCUMENTS

| | | |
|---|---|---|
| 0168949 | 6/1985 | European Pat. Off. . |
| 0194146 | 3/1986 | European Pat. Off. . |
| 0484172 | 10/1991 | European Pat. Off. . |
| 0639633 | 8/1994 | European Pat. Off. . |
| 2176108 | 12/1986 | United Kingdom . |
| 8907888 | 9/1989 | WIPO . |
| 9100010 | 1/1991 | WIPO . |
| 9210530 | 6/1992 | WIPO . |
| 9503881 | 2/1995 | WIPO . |

OTHER PUBLICATIONS

Tooling & Production, Mar. 1986, pp. 37 to 39, 42 and 43.

Busan 77 Product Bulletin printed 25 Feb. 1989.

*Primary Examiner*—Prince Willis, Jr.

*Assistant Examiner*—Cephia D. Toomer

*Attorney, Agent, or Firm*—John W. Gregg; Donald Dunn

[57] ABSTRACT

An aqueous machining fluid composition having improved resistance to microorganisms is provided. The fluid composition comprises in admixture: a) water, b) a water insoluble organic lubricant, c) a surface active agent selected from the group consisting of nonionic, anionic having up to and including 12 carbon atoms, and cationic surfactants and mixtures thereof and d) a water soluble polyquaternary cationic biocide. Machining processes comprising the step of supplying said aqueous machining fluid to the interface between the tool and the workpiece are also provided.

13 Claims, No Drawings

MACHINING FLUID COMPOSITION AND METHOD OF MACHINING

FIELD OF INVENTION

This invention relates to the art of aqueous based machining fluids and more particularly to an aqueous based machining fluid having improved resistance to microbial attack and machining methods employing the aqueous based machining fluid.

BACKGROUND OF THE INVENTION

It is known in the art of working or shaping a solid workpiece into a useful article to apply a cutting or non-cutting tool against the workpiece. The solid workpiece may be metallic or non-metallic (e.g. glass, ceramic, stone etc.). During such working or shaping the tool and/or the workpiece may, in some methods, be rotated, sometimes at high speed such as in spinning, turning or grinding processes. In other processes for working or shaping solid objects, e.g. metal objects, a tool would be pressed against the solid object with great force to cut the workpiece such as in shearing, broaching, milling, grinding, stamping and punching. In non-cutting processes solid (e.g. metal) workpieces may be shaped without cutting by applying a non-cutting tool in sliding contact against a workpiece with high force such as in spinning, extruding, rolling and drawing and ironing processes. High heat and friction are generated during these and other shaping processes causing such problems as high tool wear, distortion of the finished article, poor surface finish and out of tolerance dimensions.

In these material working processes, it is known to apply a machining fluid (e.g. metalworking fluid) composition to the interface between the tool and the workpiece to cool the tool and workpiece, to remove debris from the tool/workpiece interface and to reduce friction between the tool and workpiece. Although many machining compositions employed in the art are liquids that are fed into the tool/workpiece interface, it is known in some machining operations to coat the tool and/or the workpiece with a paste like composition as for example in a tapping operation or to pre-apply a liquid or semi liquid to the blank and/or the punch and/or die before contact is made as in a drawing and ironing process. The machining fluid composition in accordance with this invention may have any of the physical states consistent with or required by a particular material working process. As used in this disclosure the terms machining fluid and machining fluid composition are used interchangeably and shall mean a liquid applied to the interface between a tool and a solid workpiece in the shaping of the workpiece.

Machining fluids or compositions applied to the interface between a tool and a workpiece may be broadly classified into two categories. These categories are non-aqueous (i.e. oils) and aqueous based fluids or liquids. The non-aqueous machining fluids or compositions comprise an oil or mixture of oils (generally petroleum based oils) and one or more additives such as for example extreme pressure agents, corrosion inhibitors, bactericides, fungicides and odor control agents. Aqueous based machining fluids or compositions are complex combinations of water, lubricant and additives such as for example surfactants, extreme pressure agents, corrosion inhibitors, bactericides, fungicides and antifoaming agents. Aqueous based machining fluids or compositions (e.g. metalworking fluids) are further classified into soluble oil, synthetic and semi-synthetic types. Tooling and Production magazine issue of March 1986, at page 38, describes a soluble oil type machining fluid as employing a special mineral oil that disperses in water to form an opaque emulsion having oil drops of 0.0002 to 0.00008 inches in diameter suspended in a chemically stabilized solution. At the same page synthetic type machining fluids are described as consisting of wetting agents, lubricity additives, disinfectants and extreme pressure additives all dissolved in water and semi synthetic type machining fluids are described as preformed emulsions of water and oil and chemicals that employ higher concentrations of emulsifiers and have droplet sizes of 0.000004 inches or smaller forming a fluid that is translucent or transparent.

Although non-aqueous (i.e. oil based) machining (e.g. metalworking) fluids have been found to be effective in cutting and non cutting machining processes they are known to exhibit odor, health, disposal and safety problems along with availability and cost considerations. Aqueous based machining (e.g. metalworking) fluids have been found to have fewer disposal, safety and health problems than oil based (i.e. non aqueous) machining fluids and are readily available. Aqueous based machining fluids have low fire hazard, often easier disposal and many times lower cost characteristics. Thus aqueous based machining fluids or compositions have been gaining favor over oil or non-aqueous based machining fluids.

Even with their advantages, aqueous based machining fluids contain components which serve as nutrients for microbial growth and suffer during storage and use from degradation caused by micro-organisms (e.g. bacteria and fungus). Unless controlled these organisms cause such problems as odors, reduced performance (e.g. lower friction reduction), decreased corrosion control or inhibition by reduction of pH and demulsification of water and oil emulsion type machining fluid compositions. Consequently, bactericidal and fungicidal agents are incorporated in aqueous machining fluid compositions to combat or prevent the growth of and attack by micro-organisms.

It is, however, important that the biocides (e.g. bactericide and/or fungicide) not only be effective to prevent or reduce the growth of micro-organisms in the aqueous machining fluid, but also to prevent or reduce the attack of micro-organisms on the constituents of the fluid. A large number of biocides are known including for example formaldehyde, tris(hydroxymethyl) nitro methane, zinc pyridinethione, o-phenyphenol, 2,3,4,6-tetrachlorophenol, dimethoxane, 1,2-benzisothiazolin-3-one, 1,3,5-tris(furfuryl) hexahydro-S-triazine and sodium-2,4,5-trichlorophenate. Biocides usable in aqueous machining fluids vary in their effectiveness in controlling micro-organisms, stability and compatibility in the fluid. Their effectiveness (i.e. the degree and spectrum of micro-organism control), stability and compatibility in aqueous based machining fluids are dependent upon their chemical composition and structure, chemical properties and physical properties as well as the type and composition of the aqueous based machining fluid. Some biocides usable in soluble oil type aqueous machining fluids may not be effective or usable in synthetic type aqueous machining fluids. On the other hand some biocides usable in synthetic type aqueous machining fluids are found not to be usable and/or effective in semi-synthetic type aqueous machining fluids. Compatibility of the biocide in the fluid is often a particular problem for various biocides. It is important that in an aqueous machining fluid the biocide does not adversely affect the stability of the fluid during storage and use. This is especially important in the soluble oil and semi-synthetic type aqueous machining fluids. It is known that the resistance of aqueous machining fluids to the growth of and attack by micro-organisms decreases over time and with use of the fluid. The rate of decrease in such resistance can depend upon, among other things the stability and spectrum of anti-microbial effectiveness of the biocide, the storage conditions for the fluid, the amount of usage the fluid receives and the conditions under which the fluid is used. Replenishment of the biocide is often done to maintain the fluid's resistance to the growth of and attack by micro-organisms. The breakdown or loss of the fluid's resistance to micro-organisms limits or destroys the useful or effective life of the fluid, causes increased replenishment of the fluid itself or components thereof, increased changing of the used fluid for fresh fluid, increased clean up, increased disposal and increased down times for machining operations or processes, all of which lead to a decrease in the aqueous machining fluid's cost effectiveness and increased machining cost. Improvements in aqueous machining fluids to increase their resistance to micro-organisms and increase their anti-microbial life are constantly being sought.

It is, therefore, an object of this invention to provide an aqueous machining fluid composition having improved resistance to micro-organism. Another object of this invention is to overcome the micro-organism resistance disadvantages of comparable known aqueous machining fluid compositions. A further object of this invention is to provide a stable aqueous machining fluid composition having improved resistance to the growth of and attack by micro-organisms. A still further object of this invention is to provide an aqueous machining fluid composition exhibiting improved anti-microbial life.

SUMMARY OF THE INVENTION

These and other objects as will become apparent to those skilled in the art from the following description and claims are achieved by this invention for an aqueous machining fluid composition. Thus it is now provided in accordance with this invention an aqueous machining fluid composition comprising in admixture: water, a water insoluble organic lubricant, a surface active agent selected from the group consisting of nonionic, anionic having up to and including 12 carbon atoms, and cationic surfactants and mixtures thereof and a water soluble polyquaternary cationic biocide. In the context of this description and the appended claims, the phrases machining fluid composition and machining fluid shall mean a workpiece contacting fluid composition employed in and for the mechanical shaping and working of solid metallic and solid non-metallic workpieces or objects. Likewise, admixture shall include mixtures of the recited components as well as reaction products resulting from mixing of such components and from mixing of the recited components with other constituents of a machining fluid composition containing the recited components. The term workpiece, as used in this description and the appended claims shall mean that solid object which is being subject to a mechanical shaping or working process. Solid non-metallic workpieces shall include, but are not limited to, glass, ceramic and stone workpieces. Solid metallic workpieces may include, but are not limited to, steel, aluminum, brass, iron, stainless steel, copper, rolled steel, titanium and various alloy workpieces or objects. Microbicidal agent, anti-microbial agent, microbiocide and biocide are used interchangeably herein and shall mean substance or preparation for killing microbes.

DESCRIPTION OF INVENTION

There has now been discovered aqueous machining fluids of the soluble oil and the semi-synthetic type having improved resistance to the growth of and attack by micro-organisms (e.g. bacteria and fungi). Additionally there has been discovered that such improvement in the resistance to the growth of and attack by micro-organisms can be achieved by this invention while maintaining the stability (i.e. resistance to separation of the constituents) of the aqueous machining fluid. Further it has been discovered that in accordance with this invention an aqueous machining fluid composition having improved resistance to the growth of and attack by micro-organisms (i.e. microbial resistance) and resistance to instability (i.e. resistance to the separation of the fluid constituents) can include a biocide known to have de-emulsifying properties in aqueous systems (e.g. aqueous emulsions). As distinguished from synthetic type aqueous machining fluid compositions the aqueous machining fluids in accordance with this invention are of the type known in the art as soluble oil and semi-synthetic type aqueous machining fluids, both of which are known in the art to be emulsions. The aqueous machining fluid compositions produced in accordance with this invention being emulsions, it is important to maintain emulsion stability while achieving improved microbial resistance for the fluid. Both of these objectives were sought and are achieved in this invention. Of course, not only is it important to maintain stability of the aqueous machining fluid while improving the microbial resistance of the fluid it is also important to maintain the functional effectiveness of the fluid in machining methods or operations. The aqueous machining fluids produced in accordance with this invention are functionally effective in machining processes or operations.

In accordance with this invention there is provided an improved aqueous machining fluid composition comprising in admixture: a) water, b) a water insoluble organic lubricant, c) a surface active agent selected from the group consisting of nonionic, anionic having up to and including 12 carbon atoms, and cationic surfactants and mixtures thereof and d) a water soluble polyquaternary cationic compound having biocidal activity. The water soluble polyquaternary cationic compound having biocidal activity may also be termed a water soluble, polyquaternary, cationic biocide for short and such phrases may be employed interchangeably in this description and the appended claims with the same meaning. There is further provided in accordance with this invention an improved aqueous machining fluid comprising in admixture: a) water, b) a water insoluble organic lubricant, c) a surface active agent selected from the group consisting of nonionic, anionic having up to and including 12 carbon atoms, and cationic surfactants and mixtures thereof and d) a water soluble aliphatic polyquaternary cationic biocide. In accordance with this invention there is also provided aqueous machining fluids comprising in admixture: a) water, b) a water insoluble organic lubricant selected from the group consisting of water insoluble natural and synthetic organic lubricants, c) a surface active agent selected from the group consisting of nonionic, anionic having up to and including 12 carbon atoms, and cationic surfactants and mixtures thereof and d) a water soluble aliphatic polyquaternary cationic biocide. In an embodiment of this invention there is provided improved aqueous machining fluid compositions comprising in admixture: a) water, b) a water insoluble natural oil lubricant, c) a surface active agent selected from the group consisting of nonionic, anionic having up to and including 12 carbon atoms, and cationic surfactants and mixtures thereof and d) a water soluble aliphatic polyquaternary cationic biocide. In another embodiment of this invention there is provided improved aqueous machining fluids comprising in admixture: a) water, b) a water insoluble synthetic oil lubricant, c) a surface active agent selected from the group consisting of nonionic, anionic having up to and including 12 carbon atoms, and cationic surfactants and mixtures thereof and d) a water soluble aliphatic polyquaternary cationic biocide. As a further embodiment of this invention there is provided improved aqueous machining fluid compositions comprising in admixture a) from about 1% to about 99% by weight of water based on the total composition, b) a water insoluble organic lubricant selected from the group consisting of water insoluble natural and synthetic organic lubricants, c) a surface active agent selected from the group consisting of nonionic, anionic having up to and including 12 carbon atoms, and cationic surfactants and mixtures thereof and d) a water soluble aliphatic polyquaternary cationic biocide. Preferably there is provided in accordance with this invention an aqueous machining fluid composition comprising in admixture: a) from about 5% to about 99% by weight of water based on the total composition, b) a water insoluble organic lubricant selected from the group consisting of water insoluble natural and synthetic organic lubricants, c) a surface active agent selected from the group consisting of nonionic, anionic having up to and including 12 carbon atoms, and cationic surfactants and mixtures thereof and d) a water soluble aliphatic poly-quaternary, cationic biocide.

The water insoluble organic lubricant of this invention is a water insoluble organic compound or mixture of water insoluble organic compounds of lubricating viscosity that reduces the friction between the tool and the workpiece during the machining process or operation and is dispersible in water. Such water insoluble organic lubricant may be a naturally occurring substance or compound, mixture of naturally occurring substances or compounds, a synthetic organic compound, mixture of synthetic organic compounds or mixture of naturally occurring substance or compound and synthetic organic compound. Typically the water insoluble organic lubricant is a naturally occurring or synthetic oil of lubricating viscosity, usually liquids. However, a water insoluble organic lubricant may be of a somewhat viscous, but handleable, or semi liquid state, such as for example a grease that is insoluble in water. In the context of this description and the appended claims the phrase water insoluble means a water solubility of about 1% or less at room temperature (e.g. 75° F.). Water insoluble lubricants useful in this invention include but are not limited to water insoluble solvent refined or acid refined mineral oils of the paraffinic, naphthenic or mixed paraffinic and naphthenic types, oils derived from coal or shale, petroleum based oils, sulfurized oils, chlorosulfurized oils, chlorinated oils, vegetable oils including, but not limited to caster oil, soybean oil, cottonseed oil, palm oil, sunflower oil and rapeseed oil, animal oils including but not limited to lard oil and whale oil, polyolefins, fatty acid esters or amides, polymerized unsaturated $C_{12}$ to $C_{36}$ fatty acid amides and esters of polymerized unsaturated fatty acids.

Synthetic lubricating oils useful in this invention may include for example water insoluble hydrocarbon oils and halo-substituted hydrocarbon oils such as polymerized and interpolymerized olefins (e.g. polybutylenes, polypropylenes, propylene-isobutylene copolymers, chlorinated polybutylenes, etc.); alkyl benzenes (e.g. dodecylbenzenes, tetradecylbenzene, dinonylbenzenes, di-(2-ethylhexyl)benzenes, etc.); polyphenyls (e.g. biphenyls, terphenyls, etc.); and the like. Water insoluble alkylene oxide polymers and interpolymers and derivatives thereof where the terminal hydroxyl groups have been modified by esterification, etherification, etc., constitute another class of known synthetic lubricating oils. These are exemplified by the oils prepared through polymerization of ethylene oxide or propylene oxide, the alkyl and aryl ethers of these polyoxyalkylene polymers (e.g. methylpolyisopropylene glycol ether having an average molecular weight of 1,000, diphenyl ether of polyethylene glycol having a molecular weight of 500–1,000, diethyl ether of polypropylene glycol having a molecular weight of 1,000–1,500, etc.) or mono- and polycarboxylic ester thereof, for example, the acetic acid esters, mixed $C_3$–$C_8$ fatty acid esters, or the $C_{13}$Oxo acid diester of tetraethylene glycol.

Another suitable class of synthetic lubricating oils usable in the practice of this invention comprises the water insoluble esters of dicarboxylic acids (e.g. phthalic acid, succinic acid, maleic acid, azelaic acid, suberic acid, sebacic acid, fumaric acid, adipic acid, linoleic acid dimer, etc.) with a variety of alcohols (e.g. butyl alcohol, hexyl alcohol, dodecyl alcohol, 2-ethyhexyl alcohol, pentaerythritol, etc.). Specific examples of these esters include dibutyl adipate, di(2-ethylhexyl)-sebacate, di-n-hexyl fumarate, dioctyl sebacate, di-isooctyl azelate, diisodecyl sebacate, the 2-ethylhexyl diester of linoleic acid dimer, the complex ester formed by reacting one mole of sebacic acid with two moles of tetraethylene glycol and two moles of 2-ethylhexanoic acid, and the like. Silicon-based oils such as the polyalkyl-, polyaryl-, polyalkoxy-, or polyaryloxysiloxane oils and silicate oils comprise another useful class of synthetic lubricants usable in the practice of this invention (e.g. tetraethylsilicate, tetraisopropyl-silicate, tetra-(2-ethylhexyl)-silicate, tetra-(4-methyl-2-tetraethyl)-silicate, tetra-(p-tertbutylphenyl) silicate, hexyl-(4-methyl-2-pentoxyl)-disiloxane, poly(methyl)-siloxanes, poly(methyl-phenyl)-siloxanes, etc.). Other synthetic lubricating oils usable in this invention include liquid water insoluble esters of phosphorous containing acids (e.g. tricresyl phosphate, trioctyl phosphate di-ethyl ester of decane phosphonic acid, etc.), polymeric tetra-hydrofurans, and the like.

Sulfurized unsaturated esters of aliphatic carboxylic acids usable as the organic lubricant in accordance with the practice of this invention include the full and partial esters of mono, di and tri hydric alcohols (e.g. ethanol, ethylene glycol and glycerol). Examples of sulfurized unsaturated esters of aliphatic carboxylic acids include, but are not limited to, sulfurized methyloleate, sulfurized hexyl sorbate, sulfurized dodecyllinolenate, and sulfurized ethylene dilinoleate, 1,6 hexylene diricinoleate, glycerine tripalmitoleate, polyoxyethylene dioleate, polyoxypropylene disorbate and glycerine dilinoleate. The sulfurized ester of an unsaturated aliphatic carboxylic acid employed in the practice of this invention may be sulfurized fat or a sulfurized fatty oil and the fat or fatty oil which has been sulfurized may be of animal or vegetable origin. Examples of such sulfurized fatty materials usable in the practice of this invention include, but are not limited to, sulfurized tallow, sulfurized whale oil, sulfurized palm oil, sulfurized coconut oil, sulfurized rapeseed oil, sulfurized lard oil and sulfurized castor oil.

The sulfurized polymerized unsaturated fatty acid amides and esters thereof usable as water insoluble lubricants in the method of this invention may be generally derivatives of sulfurized polymerized unsaturated fatty acids that are prepared from polymerized unsaturated fatty acids obtained by polymerizing ethylenically unsaturated fatty acids having from 12 to 36 carbon atoms. Generally the polymerized unsaturated fatty acid contains from 2 to 4 monomeric units, 2 to 4 carboxylic acid groups and residual ethylenic unsaturation. The polymerization of ethylenically unsaturated fatty acids is known in the art and such acids and the methods for polymerization have been described in U.S. Pat. No. 3,256,304. Dimer, trimer and tetramer acids prepared from ethylenically unsaturated fatty acids are commercially available. For example, the dimer of linoleic acid is commercially available as EMPOL 1022 from Emery Industries (EMPOL is a registered trademark of Emery Industries). This dimer acid may contain 2 to 5% of unpolymerized linoleic acid and from 19 to 22% trimer acid. The polymerized ethylenically unsaturated fatty acid may contain a mixture of ethylenically unsaturated fatty acid, dimer acid, trimer acid and tetramer acid in varying proportions depending upon the starting ethylenically unsaturated fatty acid and the conditions under which the polymerization was carried out. Sulfurization of the polymerized unsaturated fatty acid may be achieved by methods well known in the art. Esters of polymerized unsaturated acids that may be sulfurized to produce the organic lubricant useful in the practice of this invention include, but are not limited to, mono methyl ester of dimerized linoleic acid, mono polyoxyalkylene (e.g. polyoxyethylene) glycol ester of dimerized linoleic acid, acid terminated polyoxyalkylene (e.g. polyoxyethylene) glycol diester of dimerized linoleic acid, and alcohol terminated polyoxyalkylene (e.g. polyoxypropylene oxyethylene) glycol polyester of dimerized linoleic acid. Examples of sulfurized polymerized unsaturated fatty acids for preparing amide and ester derivatives include, but are not limited to sulfurized polymerized oleic acid, sulfurized polymerized linoleic acid, sulfurized polymerized lauroleic acid, sulfurized polymerized vaccenic acid, sulfurized polymerized eleostearic acid and sulfurized polymerized linolenic acid.

Examples of sulfurized hydrocarbons usable as the organic lubricant in the practice of this invention include, but are not limited to, sulfurized olefin, olefin sulfides, aliphatic hydrocarbon sulfides (e.g. $R^5$—S—$R^6$ where $R^5$ is alkyl of 1 to 20 carbons and $R^6$ is alkyl of 3 to 20 carbons) and sulfurized polyolefin, particularly sulfurized low molecular weight polyolefins.

In the practice of this invention the water insoluble organic lubricant may vary in amount over a wide range. Typically the amount of water insoluble organic lubricant may range from about 0.01% to about 90%, preferably from about 0.028 to about 30% and more preferably from about 0.02% to about 20%, by weight based on the total aqueous machining fluid composition.

In accordance with this invention the surface active agent is selected from the group consisting of nonionic, anionic having up to and including 12 carbon atoms and cationic surfactants and mixtures thereof. Nonionic surfactants usable in the practice of this invention, for example, include, but are not limited to, condensation products of higher fatty alcohols with ethylene oxide, such as the reaction product of oleyl alcohol with 10 ethylene oxide units; condensation products of alkyl phenols with ethylene oxide, such as the reaction products of isoctylphenol with 12 ethylene oxide units; condensation products of higher fatty acid amides with five, or more, ethylene oxide units; polyethylene glycol esters of long chain fatty acids, such as tetraethylene glycol monopalmitate, hexaethyleneglycol monolaurate, nonethyleneglycol monostearate, nonethyleneglycol dioleate, tridecaethyleneglycol monoarachidate, tricosaethyleneglycol monobehenate, tricosaethyleneglycol dibehenate, polyhydric alcohol partial higher fatty acid esters such as sorbitan tristearate, ethylene oxide condensation products of polyhydric alcohol partial higher fatty esters, and their inner anhydrides (mannitol anhydride, called Mannitan, and sorbitolanhydride, called Sorbitan), such as glycerol monopalmitate reacted with 10 molecules of ethylene oxide, pentaerythritol monooleate reacted with 12 molecules of ethylene oxide, sorbitan monostearate, reacted with 10 to 15 molecules of ethylene oxide; long chain polyglycols in which one hydroxyl group is esterified with a higher fatty acid and the other hydroxy group is etherified with a low molecular alcohol, such as methoxypolyethylene glycol 550 monostearate (550 meaning the average molecular weight of the polyglycol ether).

The nonionic emulsifiers contemplated herein could be organic compounds of a relatively high molecular weight and consisting of a hydrophobic portion to which is attached a solubilizing or hydrophilic portion containing groups such as ether links (—C—O—C—), hydroxyl groups (—OH), carbonyloxy groups [—C(=O)—O—] and the like.

Specifically contemplated are surfactants having as the hydrophilic moiety one or more chains containing one or more alkyleneoxy groups. These surfactants have the general formula $$R—(Y—H)_y$$

where R is the hydrophobic portion of an aliphatic alcohol containing from about 8 to 22 carbon atoms or an alkylated phenol containing from about 4 to about 22 carbon atoms in the alkyl group thereof, Y is an alkyleneoxy chain, H is a hydrogen atom bonded to an oxygen atom of the alkyleneoxy chain, and y is an integer from 1 to about 6, and preferably from 1 to 4.

Typical aliphatic alcohols are octyl alcohol, nonyl alcohol, decyl alcohol, "coco" alcohol (a mixture of $C_{10}$ to $C_{16}$ alcohols), dodecyl alcohol, oleyl alcohol, tallow alcohol (a mixture of $C_{16}$ to $C_{18}$ alcohols), octadecyl alcohol, 2,6,8-trimethyl-4-nonyl alcohol, and the like.

Typical alkylated phenols are butylphenol, pentylphenol, hexylphenol, octylphenol, nonylphenol, dodecylphenol, hexadecylphenol, octadecylphenol, nonadecylphenol, and the like.

By the term "alkyleneoxy chain" as used herein is meant a chain containing one or more alkyleneoxy groups which are divalent alkylene groups such as methylene, ethylene, propylene, butylene, and the like, bonded to an oxygen atom in a manner such that one of the valences of the alkyleneoxy group is from an oxygen atom and the other is from a carbon atom. Typical alkyleneoxoy groups are ethyleneoxy (—$C_2H_4O$—), propyleneoxy (—$C_3H_6O$—), butyleneoxy (—$C_4H_8O$—) and the like.

Other suitable nonionic surfactants that could be used in the practice of this invention include, but are not limited to, Sorbitan sesquioleate, polyoxyethylene alkyl phenol, polyoxyethylene (10 mole) cetyl ether, polyoxyethylene alkylaryl ether, polyoxyethylene monolaurate, polyoxyethylene vegetable oil, polyoxyethylene sorbitan monolaurate, polyoxyethylene (40 mole) sorbitol hexaoleate, polyoxyethylene esters of mixed fatty and resin acids, polyoxyethylene sorbitol lanolin derivative, polyoxyethylene (12 mole) tridecyl ether, polyoxyethylene sorbitan esters of mixed fatty and resin acids, polyoxyethylene sorbitan monostearate, polyoxyethylene sorbitan monooleate, polyoxyethylene monostearate, polyoxyethylene (20 mole) stearyl ether, polyoxyethylene (20 mole) oleyl ether, polyoxyethylene (15 mole) tridecyl ether, polyoxyethylene fatty alcohol, polyoxyethylene alkyl amine, polyoxyethylene glycol monopamitate, polyoxyethylene sorbitan monopalmitate, polyoxyethylene (20 mole) cetyl ether, polyoxyethylene oxypropylene stearate, polyoxyethylene lauryl ether, polyoxyethylene lanolin derivative.

The cationic surfactants usable in the practice of this invention, for example, include, but are not limited to, oleyltrimethyl-ammonium chloride, octadecyl-di (hydroxyethyl)-methyl-ammonium chloride, distearyl-dimethyl-ammonium methyl sulfate.

Other cationic emulsifiers are the combination of an organic acid, such as acetic acid or the like, with an amine such as cyclic imidazoline, tertiary ethoxylated soya amine, tallow polyethoxylated amine having two ethoxy units in the polyethoxylated portion of the molecule, the oleyl polyethoxylated amines having two to five ethoxy units in the polyethoxy portion of the molecule, soya polyethoxylated amine having five ethoxy units in the polyethoxy portion of the molecule, and the like. Salts of long chain primary, secondary, or tertiary amines, such as oleylamine acetate, cetylamine acetate, didodecylamine lactate, the acetate of aminoethyl stearamide, dilauroyl triethylene tetraamine diacetate, 1-aminoethyl-2-heptadecenyl imidazoline acetate; and quaternary salts, such as cetylpyridinium bromide, hexadecyl ethyl morpholinium chloride, and diethyl didodecyl ammonium chloride.

Anionic surfactants usable in the practice of this invention are required to have up to and including 12 carbon atoms. These anionic surfactants, for example, include, but are not limited to, alkali metal, ammonium and amine soaps of fatty acids such as lauric, undecanoic, capric, pelargonic, caprylic, enanthic, caproic and valeric acids. Examples of such soaps include triethanolamine valerate, triethanolamine caproate, isopropanolamine pelargonate, isopropanolamine valerate, methoxy propylamine caprylate, morpholine valerate, sodium laurate, potassium caprate, ammonium caprylate and sodium undecanoate.

A combination of any two or more nonionic surfactants may be employed in the practice of this invention. Combinations of two or more anionic surfactants having up to and including 12 carbon atoms may be employed in the practice of this invention. Two or more cationic surfactants, in combination, may be used in the practice of this invention. There may also be employed in the practice of this invention a combination of any two of or a combination of all of the nonionic, anionic having up to and including 12 carbon atoms and cationic surfactants.

The water soluble aliphatic polyquaternary cationic biocide useful in the practice of this invention has two or more quaternary nitrogen atoms. Compounds of this type usable in the practice of this invention and methods for their preparation are known in the art and include but are not limited to the following disclosed materials. As described in U.S. Pat. No. 4,730,079, quaternary alkoxylated polycondensates are prepared by esterifying, with polycondensation, an alkoxylated primary fatty amine with a diol and a dicarboxylic acid, the reaction product being alkoxylated. The '079 patent described use of these polycondensates as corrosion inhibitors in aqueous systems and as demulsifiers (i.e. emulsion breakers) in water in oil and oil in water emulsions. Polyquaternary ammonium compounds prepared by combining N,N'bis(dialkylamioalkyl) ureas, hydrochloric acid, epichlorohydrin and tertiary amines and their use as microbicides, corrosion inhibitors, debonding agents, flocculants, softeners and anti static agents in water systems and as demulsifiers in oil in water and water in oil emulsions are taught in U.S. Pat. No. 4,506,081. Cationic water-soluble amine-epichlorohydrin polymeric compounds produced by reacting a primary amine or ammonia with epichlorohydrin to produce a tertiary amine polymeric precursor and self polymerizing the precursor or reacting the precursor with tertiary amines and the use of these compounds as a) drainage aids, formation aids, retention aids, sizing agents and strength improving agents in paper making and textile processes, b) agents to remove dissolved or solid particulate matter in water, c) flocculants in water systems and d) agents effective against bacteria, fungi and algae in water systems such as commercial and industrial cooling systems and swimming pools are described in U.S. Pat. No. 4,054,542. In U.S. Pat. No. 4,018,592 there is disclosed poly[2-hydroxyethylene (dimethyliminio) ethylene (dimethyliminio) methylene dichloride] and its preparation and its use for controlling the growth of algae in industrial aqueous systems (e.g. cooling towers and holding ponds) and swimming pools. Polymeric quaternary ammonium compounds or mixtures thereof having the formula $Z[—CH_2CHOHCH_2—N^+(CH_3)_2—]_n\ CHOHCH_2—Z+nX^-$ wherein Z is either X or the radical $—N(CH_3)_2$; X is a halogen of atomic weight greater than 34 and n is an integer from 2 to 20 and the method of their preparation and their use as anti-microbials in recirculating water systems such as in paper manufacturing, air conditioning, humidifiers and grinding lubricants and in swimming pools are taught in U.S. Pat. No. 4,089,977. Poly [oxyethylene(dimethyliminio) ethylene(dimethylimino) ethylene dichloride] and its preparation and its use as a non-foaming and non-irritating algicide to control algae in cooling towers, holding ponds and swimming pools are disclosed in U.S. Pat. No. 3,771,989.

The compounds disclosed in U.S. Pat. Nos. 4,730,079, 4,506,081, 4,054,542, 4,018,592, 4,089,977 and 3,771,981 are cationic substances having surfactant activity. Thus they are known to be and would be substantially ionically interactive and incompatible with anionic surfactants because of their opposite ionic character. Stable water in oil and oil in water emulsions are generally formed with long chain high molecular weight anionic surfactants (e.g. potassium stearyl sulfonate, stearyl amine hydrobromide and potassium oleate). The addition of a cationic surfactant to an oil in water and water in oil emulsion would therefore be expected to and would, in accordance with the art, destabilize the emulsion. This action (i.e. demulsifying activity) is disclosed in U.S. Pat. No. 4,730,079 and U.S. Pat. No. 4,506,081. Water in oil and oil in water emulsions are not taught or suggested in U.S. Pat. No. 4,089,977, U.S. Pat. No. 4,054,542, U.S. Pat. No. 4,018,592 and U.S. Pat. No. 3,771,989 nor are the use of the cationic compounds, disclosed therein, in stable water in oil and oil in water emulsions taught by these patents. The anionic surfactants generally used in water in oil and oil in water emulsions are long chain (e.g. 16 carbon atoms or more), somewhat high molecular weight compounds having an oil soluble moiety (e.g. a long chain fatty acid moiety) and a water soluble moiety (e.g. an alkali metal ion) for structuring and stabilizing the emulsion. The balance between the oil soluble and water soluble portions of the anionic surfactant molecule are factors in establishing its effectiveness in forming and stabilizing the emulsion. In view of the cationic nature of the compounds taught in U.S. Pat. No. 4,089,977, U.S. Pat. No. 4,054,542, U.S. Pat. No. 4,018,592 and U.S. Pat. No. 3,771,989 and the known or expected interaction and incompatibility of cationic and anionic surfactants it would be recognizable that such compounds could and would have demulsifying activity in aqueous emulsions and therefore their use in such emulsions would be discouraged or prohibited where it is intended that such emulsions would be stable. Contrary to the demulsifying behavior taught in the art however there has now been discovered, in accordance with the invention disclosed herein and in accordance with the appended claims, improved aqueous machining fluid compositions containing water and a water insoluble lubricant (e.g. oil in water and water in oil emulsion machining fluid compositions) and a water soluble aliphatic polyquaternary cationic biocide. The aqueous machining fluid compositions produced in accordance with this invention exhibit stability and improved resistance to the growth of and attack by micro-organisms.

Water soluble aliphatic polyquaternary cationic biocides usable in the practice of this invention, for example, include, but are not limited to, the polyquaternary cationic compounds taught in U.S. Pat. Nos. 4,730,079, 4,506,081, 4,506,081, 4,089,977, 4,054,542, 4,018,592 and 3,771,989, the disclosure of which compounds and their preparation are incorporated herein by reference. Preferably the water soluble aliphatic polyquaternary cationic biocide usable in the practice of this invention is poly[oxyethylene (dimethyliminio) ethylene(dimethyliminio) ethylene dichloride] available as an aqueous solution containing 60% by weight of the dichloride under the product name BUSAN 77 from Buckman Laboratories. BUSAN is a registered trademark of Buckman Laboratories. The water soluble aliphatic polyquaternary cationic biocide usable in the practice of this invention may be employed over a wide concentration range. Use may be made of concentrations of the biocide ranging from about 0.3% to about 2.0%, preferably about 0.5% to about 1.0%, by weight based on the total aqueous machining fluid composition.

There is further contemplated by the inventors, as their invention, a method for producing an aqueous machining fluid having improved resistance to attack by micro-organisms. The method comprises the steps of a) adding water, b) adding a water insoluble organic lubricant, c) adding a surface active agent selected from the group consisting of nonionic, anionic, having up to and including 12 carbon atoms, and cationic surfactants and mixtures thereof and d) adding a water soluble polyquaternary cationic biocide.

Aqueous machining fluid compositions in accordance with the invention may be produced and the method producing an aqueous machining fluid contemplated by the inventors may be practiced utilizing apparatus well known in the art. The components of the aqueous fluid compositions of the invention may be mixed in various orders. Thus, for example, water may be mixed with the surface active agent and then the water insoluble lubricant may be added to that admixture, and then the water soluble aliphatic polyquaternary cationic biocide may be added to that admixture. Aqueous machining fluid compositions in accordance with the invention may be produced by adding water soluble aliphatic polyquatenary cationic biocide to water, followed by adding the surface active agent to that admixture, followed by adding the water insoluble lubricant to that admixture. Aqueous machining fluids in accordance with the invention may be produced by combining the water and water insoluble lubricant, followed by adding the surface active agent to that admixture, followed by adding the water soluble aliphatic polyquaternary cationic biocide to that admixture. Mildly elevated temperatures (e.g. 100° F. to 175° F.) may be utilized in the production of aqueous machining fluids in accordance with the invention. Various additives known in the art may be added to the admixture of the invention in conventional amounts known in the art of aqueous machining fluid composition. Such additives known in the art may include, but are not limited to, corrosion inhibitors, biocides, fungicides, bactericides, antioxidants, water soluble lubricants, antifoamers, extreme pressure agents, metal particle precipitating agents, coloring agents and mildness additives.

Although an aqueous machining fluid composition as described in this disclosure and claimed in the appended claims requires a water soluble aliphatic polyquaternary cationic biocide, it is contemplated that there may be in addition to or in conjunction with the water soluble aliphatic polyquaternary cationic biocide other (i.e. adjunct) biocides, fungicides and bactericides known in the art in amounts well known in the art. These other biocides, fungicides and bactericides known in the art include, but are not limited to, formaldehyde, formaldehyde producing or generating compounds or substances and non-formaldehyde producing compounds or substances.

It is common practice in the art to prepare and ship aqueous machining fluid compositions in a concentrated form. Such concentrated form is then diluted with water to a use concentration by the end user (i.e. the user of the fluid) and the diluted fluid employed in the machining operation. The concentrated form of the fluid usually contains a small amount of water, typically less than 10% by weight. However larger amounts of water may be in the fluid composition prepared and shipped, which may then be diluted further with water to produce an end use concentration for the fluid. The advantage to preparing and shipping the concentrated form of the aqueous machining fluid composition is that it avoids sending large quantities of water from the producer of the fluid to the end user of the fluid since the user can economically add water to the fluid to obtain the desired use concentration. Thus preparing and shipping the concentrated form of the aqueous machining fluid composition provides an economic advantage over preparing and shipping the fluid in an end use concentration. In the context of this description and the appended claims it is intended and shall be understood that this invention for an aqueous machining fluid composition shall include the concentrated form, the diluted form for end use and all concentrations therebetween of the aqueous machining fluid composition.

The aqueous machining fluid compositions of this invention may be employed in the mechanical shaping of metallic (e.g. steel) workpieces by cutting and non-cutting methods and may also be employed in the mechanical shaping of solid non-metallic workpieces, such as for example sawing, turning, drilling and grinding of glass, ceramic and stone workpieces as well as the mechanical shaping of plastic workpieces as for example by sawing, drilling, milling and grinding. Preferably the aqueous machining fluid compositions of this invention, as disclosed herein and claimed in the appended claims are soluble oil and semi-synthetic type aqueous machining fluid compositions and are distinguished from synthetic type aqueous machining fluids.

In accordance with their discovery the inventors contemplate as part of their invention: a) aqueous machining fluid compositions in accordance with this invention; b) a method of for producing an aqueous machining fluid comprising the steps of adding water, adding a water insoluble organic lubricant, adding a surface active agent selected from the group consisting of nonionic, anionic, having up to and including 12 carbon atoms, and cationic surfactants and mixtures thereof, and adding a water soluble polyquaternary cationic biocide; and, c) machining processes comprising the step of supplying an aqueous machining fluid composition in accordance with this invention to the interface between a tool and a workpiece. The practice of machining processes contemplated by the inventors as part of their invention includes, but is not limited to, those machining processes identified and described herein. Thus in accordance with this invention there are provided aqueous machining fluid compositions comprising in admixture a) water, b) a water insoluble organic lubricant, c) a surface active agent selected from the group consisting of nonionic, anionic having up to and including 12 carbon atoms, and cationic surfactants and mixtures thereof and d) a water soluble polyquaternary cationic biocide. Further in accordance with this invention there are provided aqueous metalworking fluid compositions wherein: a) the water soluble polyquaternary cationic biocide is a water soluble aliphatic polyquaternary cationic biocide, b) the water insoluble organic lubricant is selected from the group consisting of water insoluble natural and synthetic organic lubricants and mixtures thereof, c) the water soluble polyquaternary cationic biocide is poly [oxyethylene (dimethyliminio) ethylene (dimethyliminio) ethylene dichloride] and d) at least any two but less than all, of the water, water insoluble organic lubricant, surface active agent selected from the group consisting of nonionic, anionic having up to and including 12 carbon atoms, and cationic surfactants and mixtures thereof and water soluble polyquaternary cationic biocide are mixed to produce an admixture with which the remaining of said components are mixed.

Aqueous machining fluid compositions produced in accordance this invention have exhibited stability (i.e. resistance to separation and/or de-emulsification) for at least 48 hours. This result is in marked contrast to and contrary to the prior art known de-emulsification effect of polyquaternary cationic biocides in oil in water and water in oil emulsions and the use in the prior art of polyquaternary cationic biocide materials to separate water from oil and oil from water.

This invention will now be further described with reference to the following non-limiting examples in which all amounts, proportions, ratios and percentages are by weight and all temperatures are in degrees Fahrenheit unless otherwise stated.

| | Examples 1 to 6 Example No. | | | | | |
|---|---|---|---|---|---|---|
| Component | 1 | 2 | 3 | 4 | 5 | 6 |
| Phase 1 | | | | | | |
| Water | 72.1 | 62.7 | 57.0 | 58.2 | 43.9 | 73.2 |
| Triethanolamine | 6.0 | 10.0 | 10.0 | 10.0 | 10.0 | 6.0 |
| Monoethanolamine | 2.4 | 5.0 | 5.0 | 5.0 | 5.0 | 2.4 |
| Pelargonic acid | 0.6 | 2.5 | 1.8 | 1.8 | 1.8 | 0.6 |
| Neodecanoic acid | 2.2 | — | — | — | — | 2.2 |
| Sebacic acid | 1.2 | 4.0 | 4.0 | 4.0 | 4.0 | 1.2 |
| BUSAN 77 (1) | 0.6 | 1.0 | 1.2 | — | 0.8 | 0.8 |
| T-Maz 20 (2) | 1.3 | 1.3 | — | — | — | 1.0 |
| MACOL DNP 10 (3) | 2.3 | 2.3 | — | — | — | 2.0 |
| ANTAROX BL-236 (4) | — | — | | | 0.5 | — |
| Caustic Potash (45% | 1.2 | 1.2 | 0.9 | 0.9 | 0.9 | — |
| MEA-BA (5) | — | — | 10.0 | 10.0 | 10.0 | — |
| TERGITOL NP-6 (6) | — | — | — | — | 0.3 | — |
| Phase 2 | | | | | | |
| Oil | 5.5 | 5.4 | 5.5 | 5.5 | 6.0 | 6.0 |
| VARINE T (7) | 4.6 | 4.6 | 4.6 | 4.6 | 4.6 | 4.6 |
| Test A (days) | 45 | 50 | 55 | 10 | 50 | 52 |

(1) BUSAN 77—Poly[oxyethylene(dimethyliminio) ethylene (dimethylimino) ethylene dichloride] - Buckman Laboratories - BUSAN is a registered trademark of Buckman Laboratories
(2) T-MAZ 20—Sorbitan monolaurate ethoxylated with 20 moles of ethylene oxide - PPG Corp. - T-MAZ is a registered trademark of PPG Corp.
(3) MACOL DNP 10—Dinonylphenol ethoxylated with 10 moles of ethylene oxide - PPG Corp. - MACOL is a registered trademark of PPG Corp.
(4) ANTAROX BL-236—aliphatic polyether - Rhone Poulenc - ANTAROX is a registered trademark of Rhone-Poulenc -continued

| | Examples 1 to 6 Example No. | | | | | |
|---|---|---|---|---|---|---|
| Component | 1 | 2 | 3 | 4 | 5 | 6 |

(5) MEA-BA—a mixture of 35.7% water, 14.3% monoethanolamine and 50% boric acid by weight
(6) TERGITOL NP-6—nonylphenol ethoxylated with 6 moles of ethylene oxide - Union Carbide Corp. - TERGITOL is a registered trademark of Union Carbide Corp.
(7) VARINE T—Tall oil hydroxyethylimidazoline - Sherex Corp. - VARINE is a registered trademark of Sherex Corp.

Examples 7 to 10

| | Example No. | | | |
|---|---|---|---|---|
| Component | 7 | 8 | 9 | 10 |
| Phase 1 | | | | |
| Water | 48.4 | 47.8 | 47.6 | 47.2 |
| Triethanolamine | 12.0 | 12.0 | 12.0 | 12.0 |
| Monoethanolamine | 6.0 | 6.0 | 6.0 | 6.0 |
| Pelargonic acid | 1.7 | 1.7 | 1.7 | 1.7 |
| Sebacic acid | 4.0 | 4.0 | 4.0 | 4.0 |
| BUSAN 77 (1) | — | 0.6 | 0.8 | 1.2 |
| Caustic potash | 4.0 | 4.0 | 4.0 | 4.0 |
| MEA-BA (5) | 8.0 | 8.0 | 8.0 | 8.0 |
| Formaldehyde | 2.5 | 2.5 | 2.5 | 2.5 |
| Phase 2 | | | | |
| Oil | 5.0 | 5.0 | 5.0 | 5.0 |
| MAPEG 400MS (8) | 0.9 | 0.9 | 0.9 | 0.9 |
| MACOL DNP 10 (3 | 2.8 | 2.8 | 2.8 | 2.8 |
| SORBAX HO 50 (9) | 2.8 | 2.8 | 2.8 | 2.8 |
| MAPEG 400 DO (10) | 1.9 | 1.9 | 1.9 | 1.9 |
| Test B (days) | 15 | 60 | 67 | 67 |
| V-tool test (lbs) | 465 | 470 | 465 | 465 |

(8) MAPEG 400 MS - Polyethylene glycol (MW 400) monostearate - Mazer Corp. - MAPEG is a registered trademark of Mazer Corp.
(9) SORBAX HO 50 - Polyoxyethylene sorbitan hexaoleate - Chemax, Inc. - SORBAX is a registered trademark of Chemax Inc
(10) MAPEG 400 DO - Polyethylene glycol (MW 400) dioleate - Mazer Corp. - MAPEG is a registered trademark of Mazer Corp.

The aqueous machining fluid compositions of Examples 1 to 10 were produced by the following method. Phase 1 was prepared by the steps of mixing each of the listed constituents of phase 1 with continuous agitation, heating the mixture to 110° F. and continuing agitation until a clear admixture was formed. Phase 2 was prepared by the steps of mixing each of the listed constituents of phase 2 with continuous agitation, heating the mixture up to 130° F. and continuing agitation until a uniform admixture was obtained. Phase 2 at 130° was then added to phase 1 at 110° with continuous agitation until a clear uniform product was obtained, to produce the aqueous machining fluid of the example.

The following test procedures for evaluation of bacteria control performance and machining performance were employed in the above examples. In the bacteria control performance tests A and B the results are reported in terms of the number of days to termination of the test (i.e. failure of the fluid). Results obtained in the V-tool test are reported in terms of pounds of force during cutting.

TEST A

The test liquid was prepared by mixing 97 grams of sterile, 125 PPM total hardness water with 3 grams of the aqueous machining fluid composition produced in the example, to be tested, in a beaker until a uniform liquid was obtained, using a magnetic stirrer. The pH of the test liquid was then adjusted to 8.5 by bubbling $CO_2$ into the test liquid while continuing to agitate the liquid. 100 grams of the test liquid was then placed in a sterile 8 ounce French square bottle and the liquid inoculated with 0.02 milliliters of a standard mix bacteria culture inocula of gram negative bacteria that included Citrobacter sp., Enterobacter sp., *Escherichia coli*, Proteus sp. and Psuedomonas sp. The capped French square bottle containing the bacteria inoculated test liquid and having the cap loosened one quarter turn was placed on a gyratory shaker and the liquid agitated continuously during the test. Using a Easicult dip slide and procedure from Orion Diagnostic Inc. the bacteria level (i.e. count) in the test liquid was determined on a daily basis. Failure of the test liquid and thus termination of the test was considered to occur when two consecutive daily bacteria counts reached $10^7$ bacteria per milliliter or greater. The test result is expressed in the number of days to termination of the test. The longer the test liquid went before reaching two consecutive daily bacteria count of $10^7$ or greater the better was the bacteria control performance of the test liquid and thus the formulation.

TEST B

The test liquid was prepared by mixing 950 grams of sterile, 125 PPM total hardness water with 50 grams of the aqueous machining fluid composition produced in the example until a uniform mixture was obtained. The test liquid was placed in an apparatus using a 1 gallon container having an outlet near the bottom of the container that is connected to the inlet of a pump. A supply line on the outlet side of the pump was arranged to supply fluid into the top of the container such that the test fluid placed in the container is continuously circulated into and out of the container by the pump. The container of the apparatus had a column of metal slats arranged in a continuous Z pattern and a quantity of cast iron chips positioned above the reservoir of test fluid in the container. The test fluid in the container was inoculated daily with 2 milliliters of a bacteria culture inocula of gram negative bacteria that included Citrobacter sp., Enterobacter sp., *Escherichia coli*, Proteus sp. and Pseudomonas sp. and 3 milliliters of a mold. Circulation of the test fluid in the apparatus was maintained during the entire test period and the test terminated when a bacteria count of $5\times10^7$ per milliliter of fluid and a mold count of $10^3$ per milliliter of fluid or greater is found for 3 days. The bacteria counts were made daily using a Easicult dip slide and procedure from Orion Diagnostics Inc. The number of days to termination of the test is reported in each example. The longer the test fluid went before termination of the test (ie. failure) the better was the bacteria control performance of the test fluid.

V-TOOL TEST PROCEDURE

A wedge-shaped high speed tool is forced against the end of a rotating (95 surface feet per minute) SAE 1026 steel tube of one fourth of an inch thickness. The feed force of the tool is sufficient to cut a V-groove in the tubing wall, and the chips flow out of the cutting area in two pieces (one piece from each face of the wedge-shaped tool). The forces on the tool as a result of workpiece rotation and of tool feed were measured by a tool post dynamometer connected to a Gould recorder and are reported in pounds. Any welding of chips to tool build-up is reflected in the interruption of chip flow (visual) and in increased resistance to workpiece rotation. The cutting test is performed with the tool-chip interface flooded throughout the operation with 3000 grams of circulating test fluid. Tool and workpiece are in constant dynamic contact during this time, and the test is not begun until full contact is achieved all along each cutting edge. The duration of the test is three minutes.

This invention has been described with reference to non-limiting specific embodiments. It will be recognized by those skilled in the art that various other embodiments may be practiced that are within the intent and scope of this disclosure and claimed invention and are therefore intended to be and are to be included within the scope of this disclosure and the appended claims.

What is claimed is:

1. An aqueous machining fluid composition comprising in admixture:

a) water;

b) a water insoluble organic lubricant;

c) a surface active agent selected from the group consisting of nonionic, anionic having up to and including 12 carbon atoms, and cationic surfactants and mixtures thereof; and d) a water soluble polyquaternary cationic biocide, with the proviso that the water insoluble organic lubricant is not a synthetic lubricant.

2. The aqueous machining fluid composition of claim 1 wherein the water soluble polyquaternary cationic biocide is a water soluble aliphatic polyquaternary cationic biocide.

3. The aqueous machining fluid composition of claim 1 wherein the water soluble polyquaternary cationic biocide is poly [oxyethylene (dimethyliminio) ethylene (dimethyliminio) ethylene dichloride].

4. The aqueous machining fluid composition of claim 1 wherein the water insoluble organic lubricant is a petroleum based oil.

5. The aqueous machining fluid composition of claim 1 wherein the water insoluble organic lubricant is a mineral oil.

6. The aqueous machining fluid composition of claim 2 wherein the water insoluble organic lubricant is a petroleum based oil.

7. The aqueous machining fluid composition of claim 2 wherein the water insoluble organic lubricant is a mineral oil.

8. The aqueous machining fluid composition of claim 3 wherein the water insoluble organic lubricant is a petroleum based oil.

9. The aqueous machining fluid composition of claim 1 further comprising at least one material selected from the group consisting of a corrosion inhibitor, odor control agent, antifoam agent, settling agent, antimicrobial agent other than a water soluble polyquaternary cationic biocide, coloring agent, clarifying agent, fragrance and antimisting agent.

10. A machining process comprising the steps of supplying an aqueous fluid composition according to claim 1 to the interface between a tool and a workpiece.

11. A machining process comprising the step of supplying an aqueous machining fluid composition according to claim 2 to the interface between a tool and a workpiece.

12. A machining process comprising the step of supplying an aqueous machining fluid composition according to claim 3 to the interface between a tool and a workpiece.

13. A machining process comprising the step of supplying an aqueous machining fluid composition according to claim 9 to the interface between a tool and a workpiece.

* * * * *